United States Patent [19]

Schädlich et al.

[11] Patent Number: 4,515,303

[45] Date of Patent: May 7, 1985

[54] ELECTRIC HAMMERING APPARATUS WITH AIR-CUSHIONED ARMATURE

[75] Inventors: Fritz Schädlich, Leinfelden-Echterdingen; Werner Rieker, Steinenbronn; Rainer Thaler, Stuttgart; Klaus Klingenstein, Leinfelden-Echterdingen, all of Fed. Rep. of Germany

[73] Assignee: Robert Bosch GmbH, Stuttgart, Fed. Rep. of Germany

[21] Appl. No.: 503,176

[22] Filed: Jun. 10, 1983

[30] Foreign Application Priority Data

Aug. 28, 1982 [DE] Fed. Rep. of Germany ..... 3232120

[51] Int. Cl.[3] ..... B25C 1/00; B25C 5/02; B25C 5/06

[52] U.S. Cl. ..... 227/131; 227/130; 227/134; 173/121; 173/139

[58] Field of Search ..... 227/120, 130, 131, 134; 173/119, 120, 121, 162 R, 139

[56] References Cited

U.S. PATENT DOCUMENTS

| | | | |
|---|---|---|---|
| 1,853,695 | 4/1932 | Mortimer | 173/119 |
| 4,183,453 | 1/1980 | Barrett et al. | 227/131 |
| 4,441,644 | 4/1984 | Farian | 173/139 X |

FOREIGN PATENT DOCUMENTS

| | | | |
|---|---|---|---|
| 1039001 | 9/1978 | Canada | 227/131 |
| 0054782 | 4/1981 | European Pat. Off. . | |

*Primary Examiner*—Paul A. Bell
*Assistant Examiner*—Taylor J. Ross
*Attorney, Agent, or Firm*—Frishauf, Holtz, Goodman & Woodward

[57] ABSTRACT

To prevent bounce of a hammer or plunger element coupled to an insertion blade of a stapling or nailing gun upon return of the plunger element to rest position by a spring (11), the plunger element (4) is in cup shape, sliding about a hollow cylinder (6) which is vented to ambient air (8) at one end, but closed at its other end by a flap-type check valve (9). Upon downward movement of the plunger element, for example under electromagnetic force of a solenoid (2), air can flow freely from the vent opening (8) into the hollow interior and through the then open check valve (9); upon return movement under force of a spring (11), the flap valve (9) will close, however, thus forming an air cushion or air damper and preventing rapid, uncontrolled return of the plunger element to rest position, due to an air throttling path (19) between the outside of the hollow cylinder and the inner surface of the plunger element (4), said air throttling path being defined by the operating clearance between the plunger (4) and the hollow cylinder (6). The hollow cylinder (6) may be constructed as a guide element, unitary with the valve, and made of plastic, the valve being secured by a living hinge to the remainder of the hollow cylinder.

14 Claims, 1 Drawing Figure

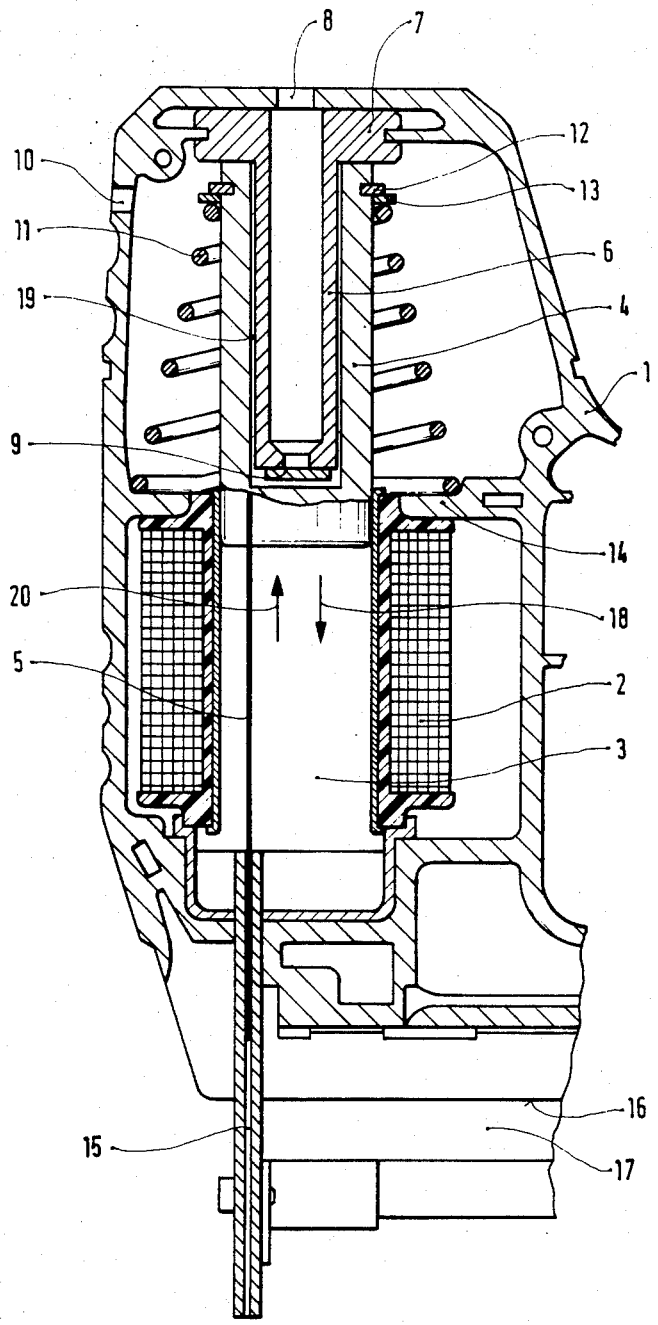
8
7
12
10
13
11
6
19
4
1
9
14
20
18
5
2
3
16
15
17

ELECTRIC HAMMERING APPARATUS WITH AIR-CUSHIONED ARMATURE

The present invention relates to an electric hand tool, and more particularly to electrical hammering apparatus, especially to nailing and stapling guns, in which a hammer head is reciprocated in a guideway, propelled by electromagnetic force and returned to an initial position by a spring.

BACKGROUND

Various types of electrical hand tool hammering apparatus are known. In one such structure—see, for example, Published European Patent Application No. 0054782, a hammer head element is returned to an initial or starting position by a spring. To absorb the shock of the returning hammer head, and thus prevent vibration and transfer of reactive forces to the operator's hand holding the apparatus, a rubber buffer is provided to accept the returning hammer head at the end of its returning movement. It has been found that the energy which is to be accepted by the rubber bumper or rubber buffer at times causes the rubber buffer to bounce, i.e. to propel the hammer element backwardly into its working or operating direction. A feeding blade operated by the hammer element, for example a blade which feeds a staple or a nail from a supply magazine can then sever a nail or staple from the supply stack by the returning bouncing blade and can transport the thus severed fastening element, into the guide or injection duct towards the nailing or stapling position without, however, ejecting the nail or staple. The hammer head is then returned to its initial position by the spring. Upon a subsequent operation of the hammering gun, a further fastening element is severed from a magazine stack which will interfere with the already present previously introduced fastening element, resulting in faulty operation and, under particularly poor operating conditions, jamming of the guideway.

It has been proposed—see the referenced European Patent Application No. 0054782—to provide a system which prevents projection of the hammer head after an operating stroke, unless specifically controlled to do so. The system there proposed is comparatively complex and requires additional space. Further, it is subject to rapid wear, requiring frequent exchange of the buffer or bumper accepting element. To permit such exchange of this element, which, normally, is securely retained within the housing of the tool, requires further structural changes to standard housings, additionally increasing the complexity of the structure, and requiring careful maintenance thereof.

THE INVENTION

It is an object to improve an impact tool, such as a nailing or stapling gun-type tool, such that the energy imparted by a return spring to a hammering head can be readily absorbed, without bounce or chatter of the returning hammering element.

Briefly, an air throttle path is provided, located in the path of movement of the plunger or hammer head element. The air throttle path includes a check valve permitting free movement of the hammer head or plunger element, independently of air throttling, in the hammering direction, for example under power of a motive means; upon reversal of the direction of movement of the hammering head or plunger, however, for example under force of the spring, the air throttle path becomes effective and dampens movement of the plunger or hammering head towards its rest position, from which a further impact can then be initiated.

The system has the advantage that a structurally simple element can be used which has a long lifetime with low maintenance requirements. In accordance with a feature of the invention, the air throttling path can be provided by a clearance or gap between a guide cylinder about which the plunger operates in the form of an apertured head, the check valve being formed by a flap element at the end of the cylinder which has a hollow interior, to provide for free movement of air in a guide path, and through the interior of the cylinder to both ends of the cylinder. Upon return movement, however, the flap valve closes; thus return movement of the head element is damped by an air cushion which can leak gradually through the throttling path defined by the clearance space between the cylinder and the surrounding head.

The structure requires hardly any additional space, and the combination of the air damper with the check valve, preferably a flap valve, provides for an ideal operating cycle with undamped operation in forward or hammering direction with effectively damped return movement to the initial or quiescent position.

Constructing the air damper and the throttling path as part of the guideway or guide track for the plunger or hammer head element, that is, forming it as a cylinder about which the plunger or hammer head operates, is a particularly preferred arrangement since additional guide elements need not be provided. Constructing the system as a hollow cylinder about which a cup-shaped hammer or plunger head is reciprocatably received, provides for ideal damping characteristics with increased damping effect as the plunger reaches the final or rest position.

DRAWING

The single FIGURE is a longitudinal section view of the operating part of a stapling gun.

DETAILED DESCRIPTION

An operating housing 1 of an impact hammering device, illustrated in the FIGURE as a stapling gun, has a solenoid coil 2 located therein. The coil 2 defines a cylindrical inner space 3 in which a cup-shaped armature 4, forming a hammering head, is slidably guided. The cup-shaped armature is coupled to an impact blade 5 which is guided in a guideway 15, in accordance with well known construction, for example to pick up staples from a staple magazine 17 within a slide duct 16.

The armature 4 is axially guided on a hollow cylinder 6. The end portion 7 of the hollow cylinder 6 is of enlarged diameter and is rigidly secured with the housing 1 of the stapling gun. The interior space of the hollow cylinder 6 is connected by an opening 8 in the housing with ambient air. A flap valve 9 is secured to the inner portion of the hollow cylinder 6 and so arranged that air entering into the hollow cylinder can pass without hindrance therethrough, but prevents air from passing from the housing to the interior space of the hollow cylinder, and hence to the outside. The flap valve 9, thus, forms a check valve which closes in upward direction. The space surrounding the armature or hammer or plunger element 4 is vented to the outside by an opening 10 formed within the housing of the apparatus. A conical spiral spring 11 is engaged against a spring ring 12 on the armature 4 over a disk or washer 13 fitted about the armature, and assembled thereon, in advance of snapping-in the spring ring 12. The counter-bearing for the spring 11 is formed by an interiorly extending rib 14 of the housing.

Operation: Upon energization of coil 2, the magnetic field rapidly attracts the armature-hammer or plunger element 4 into the interior of the coil, moving the knife 5 in downward direction, that is, in the direction of arrow 18. This pushes the knife blade 5 through the guide duct 15, severing a staple, nail or other fastening element from a stack thereof within the duct 16, and driving the fastening element into a workpiece located at the end of the duct 15. As the armature 4 moves downwardly, air is sucked in through the opening 8 into the interior of the hollow cylinder 6, the flap valve 9 permitting ready entrance of air thereinto. Thus, the hammering operation is not impeded by air entering into the hollow cylinder, and surrounding the plunger or hammer element 4.

Upon termination of the electrical power pulse, the collapsing magnetic field frees the armature-hammer element 4, so that the spring 11 can retract or return the armature element to the starting or quiescent position, as shown in the FIGURE. The air within the hollow cylinder cannot, however, escape readily through the opening 8 since the flap valve 9 has closed. The air, thus, is pressed through the narrow gap 19, forming a throttling gap, between the armature 4 and the hollow cylinder 6. Return movement of the armature 4 in the direction of the arrow 20 thus is effectively damped and prevents bounce-back of the armature element 4 when it engages the end portion 7 of the hollow cylinder 6, which forms an interior guide post for movement of the armature or plunger or hammer element 4. The damped return movement, due to throttling of the air escape path through the narrow gap 19 thus insures bounce-free seating of the hammer element 4 in its quiescent position upon return by the spring 11.

In accordance with a feature of the invention, the throttling gap 19 is formed to be slightly conical, narrowing towards the end 7, so that, as the hammer head 4 approaches its end position, the throttling effect increases, thus providing for effective cushioning before the element 4 reaches its final position. The gap, thus, can taper slightly upwardly to increase the damping effect with increasing travel of the element 4 to rest position.

The valve 9 preferably is made of elastic material, such as rubber or plastic, secured to the hollow cylinder 6 by any suitable means, for example by adhesives, rivets, or screws. The hollow cylinder 6 may be made of plastic and, if so, the flap valve can be made integral therewith, for example by forming the flap valve with a "living hinge" of the same plastic material as the cylinder 6. Other materials, of course, may be used, and the valve can be made separately, for example of rubber, adhesively connected to a hollow metal guide cylinder 6.

Various changes and modifications may be made within the scope of the inventive concept.

We claim:

1. Electric hammering tool apparatus, particularly nailing or stapling gun, having a housing (1);

a plunger element (4) positioned for reciprocating movement in the housing;

a solenoid coil (2) and a return spring (11) forming a motive means (2, 11) respectively reciprocating the plunger element in the housing, the plunger element forming an armature (4) in electromagnetic cooperation with said solenoid coil;

and comprising, in accordance with the invention, an air throttle path (19) located in the path of movement of the plunger element and including a check valve (9) permitting free movement of the plunger element independently of throttling of the plunger element in a hammering direction (18), under power of the motive means, while damping movement of the plunger element in a return direction and rendering effective said air throttling path;

and a hollow cylinder (6) forming a guide means for said armature;

means (7) for securing one end (7) of the hollow cylinder in the housing;

an air vent opening communicating the interior of the hollow cylinder with ambient air outside of the housing;

and wherein the check valve (9) is located at the other end of the hollow cylinder, the plunger element being a cup-shaped piston element surrounding said hollow cylinder, with clearance, said clearance defining a narrow gap forming an air throttle path (19).

2. Apparatus according to claim 1, wherein said narrow gap, and hence said throttle path, is slightly conical, having its narrowest portion adjacent the housing.

3. Apparatus according to claim 1, wherein said gap defining said throttle path is of sufficient size to define a clearance gap for free sliding, reciprocating operation of the plunger element on the outside of the hollow cylinder.

4. Apparatus according to claim 1, wherein said check valve comprises a flap valve (9) located at the end of the hollow cylinder remote from said attachment means to the housing, and resiliently engaging the end of said hollow cylinder to close off the hollow interior thereof with respect to the adjacent cup-shaped portion of the plunger element (4).

5. Apparatus according to claim 4, wherein said flap valve comprises a flap of elastic material secured to the end portion of said hollow cylinder at the end remote from said attachment means.

6. Apparatus according to claim 1, wherein said hollow cylinder comprises plastic material.

7. Apparatus according to claim 1, wherein said hollow cylinder comprises plastic material;

and wherein said flap valve is unitary with said hollow cylinder, and comprises a plastic flap connected to the hollow cylinder by a living hinge.

8. Electric hammering tool apparatus, particularly nailing or stapling gun, having a housing (1);

a hollow cylinder (6) secured at one end (7) in the housing;

an air vent opening (8) communicating the interior of the hollow cylinder with ambient air;

a solenoid coil (2) and a return spring (11);

a plunger element (4) positioned for reciprocating movement in the housing, the plunger element comprising a cup-shaped armature (4) in electromagnetic cooperation with said solenoid coil, closely surrounding the outside of said cylinder (6) leaving only a narrow gap, and guided by the cylinder in its reciprocating movement, said narrow gap defining an air throttling path (19);

and a check valve (9) closing off air flow communication between the interior of the hollow cylinder (6) and said air vent opening (8) for permitting free movement of the plunger element in a hammering direction, while damping movement of the plunger element in a return direction under force of the return spring, and rendering effective said air throttling path by permitting escape of air sucked through the hollow cylinder into the interior of the cup-shaped armature only through said narrow gap defining said air throttling path (19).

9. Apparatus according to claim 8, wherein said narrow gap, and hence said throttle path, is slightly conical, having its narrowest portion adjacent the housing.

10. Apparatus according to claim 8, wherein said gap defining said throttle path is of sufficient size to define a clearance gap for free sliding, reciprocating operation of the plunger element on the outside of the hollow cylinder.

11. Apparatus according to claim 8, wherein said check valve comprises a flap valve (9) located at the end of the hollow cylinder remote from said attachment means to the housing, and resiliently engaging the end of said hollow cylinder to close off the hollow interior thereof with respect to the adjacent cup-shaped portion of the plunger element (4).

12. Apparatus according to claim 11, wherein said flap valve comprises a flap of elastic material secured to the end portion of said hollow cylinder at the end remote from said attachment means.

13. Apparatus according to claim 8, wherein said hollow cylinder comprises plastic material.

14. Apparatus according to claim 8, wherein said hollow cylinder comprises plastic material;

and wherein said flap valve is unitary with said hollow cylinder, and comprises a plastic flap connected to the hollow cylinder by a living hinge.

* * * * *